US007445058B2

(12) United States Patent
Blangé

(10) Patent No.: US 7,445,058 B2
(45) Date of Patent: Nov. 4, 2008

(54) NOZZLE UNIT AND METHOD FOR EXCAVATING A HOLE IN AN OBJECT

(75) Inventor: Jan-Jette Blangé, Rijswijk (NL)

(73) Assignee: Shell Oil Company, Houston, TX (US)

( * ) Notice: Subject to any disclaimer, the term of this patent is extended or adjusted under 35 U.S.C. 154(b) by 231 days.

(21) Appl. No.: 10/576,855

(22) PCT Filed: Oct. 20, 2004

(86) PCT No.: PCT/EP2004/052593

§ 371 (c)(1),
(2), (4) Date: Apr. 19, 2006

(87) PCT Pub. No.: WO2005/038189

PCT Pub. Date: Apr. 28, 2005

(65) Prior Publication Data

US 2007/0131455 A1 Jun. 14, 2007

(30) Foreign Application Priority Data

Oct. 21, 2003 (EP) ..... 03103883
Jul. 8, 2004 (WO) ..... PCT/EP2004/051407

(51) Int. Cl.
*E21B 7/18* (2006.01)
*B24C 5/04* (2006.01)

(52) U.S. Cl. ..... 175/67; 175/424; 175/54; 451/38; 451/102

(58) Field of Classification Search ..... 175/54, 175/67, 393, 424; 239/419, 433, 434; 451/38, 451/90, 101, 102
See application file for complete search history.

(56) References Cited

U.S. PATENT DOCUMENTS

| | | | | | |
|---|---|---|---|---|---|
| 2,779,571 | A | | 1/1957 | Ortloff | 255/61 |
| 4,555,872 | A | * | 12/1985 | Yie | 451/40 |
| 4,707,952 | A | * | 11/1987 | Krasnoff | 451/75 |
| 4,815,241 | A | * | 3/1989 | Woodson | 451/102 |
| 5,462,605 | A | * | 10/1995 | Szucs | 134/7 |
| 5,560,547 | A | * | 10/1996 | Mutter et al. | 239/433 |
| 5,857,900 | A | * | 1/1999 | Shank, Jr. | 451/102 |
| 6,077,152 | A | * | 6/2000 | Warehime | 451/75 |

(Continued)

FOREIGN PATENT DOCUMENTS

EP 0 119 338 A1 * 9/1984

(Continued)

OTHER PUBLICATIONS

International Search Report for PCT/EP2004/052593, Schouten, EPO, Jan. 25, 2005, pp. 1-3.*

(Continued)

*Primary Examiner*—David J. Bagnell
*Assistant Examiner*—David Andrews

(57) ABSTRACT

A nozzle unit for generating an abrasive jet. The nozzle unit has a first nozzle connected to a pressurized carrier fluid supply; a mixing chamber in which the first nozzle discharges; and a second nozzle connected to the mixing chamber. An abrasive particle inlet discharges in the mixing chamber. A proportion of the cross sectional area of the first nozzle opening ($A_1$) and the cross sectional area of the second nozzle opening ($A_2$) is in a range of 0.50-1.0.

9 Claims, 3 Drawing Sheets

U.S. PATENT DOCUMENTS

| | | | | |
|---|---|---|---|---|
| 6,283,833 | B1 | 9/2001 | Pao et al. | 451/40 |
| 6,386,466 | B1 * | 5/2002 | Ozawa et al. | 239/433 |
| 6,691,928 | B2 * | 2/2004 | Chung et al. | 239/8 |
| 6,752,685 | B2 * | 6/2004 | Ulrich et al. | 451/2 |
| 2002/0079998 | A1 * | 6/2002 | Blange | 335/302 |
| 2006/0185907 | A1 * | 8/2006 | Blange | 175/424 |

FOREIGN PATENT DOCUMENTS

| | | | |
|---|---|---|---|
| EP | 0119338 | | 9/1984 |
| EP | 0 526 087 | A1 * | 2/1993 |
| EP | 0526087 | | 2/1993 |
| WO | 00/66872 | | 11/2000 |
| WO | 02/34653 | | 5/2002 |
| WO | 02/092956 | | 11/2002 |
| WO | 2005/005765 | | 1/2005 |
| WO | 2005/005766 | | 1/2005 |
| WO | 2005/005768 | | 1/2005 |
| WO | 2005005767 | | 1/2005 |
| WO | 2005038189 | | 4/2005 |
| WO | 2005/040546 | | 5/2005 |
| WO | 2005/051426 | | 6/2005 |

OTHER PUBLICATIONS

Written Opinion of the ISA for PCT/EP2004/052593, Schouten, EPO, Jan. 24, 2005, pp. 1-5.*

International Preliminary Report on Patentability for PCT/EP2004/052593, Schouten, EPO, Nov. 7, 2005, pp. 1-6.*

R.D. Blevins, Applied Fluid Dynamics Handbook, 1992, p. 260.

International Search Reprot PCT/EP2004/052593 dated Jan. 14, 2005.

* cited by examiner

Efficiency
50%
40%
30%
20%
10%
0%
0
0.1
0.2
0.3
0.4
0.5
0.6
0.7
0.8
0.9
1.0
A1/A2
31
32
33
33a
33b
33c
33d
34
34a
34b
34c
34d
34e
W
60%
50%
40%
30%
20%
10%
10%
8%
6%
4%
2%

NOZZLE UNIT AND METHOD FOR EXCAVATING A HOLE IN AN OBJECT

PRIORITY CLAIM AND CROSS REFERENCE

The present application is a 35 U.S.C. 371 national stage filing of PCT/EP2004/052593 filed 20 Oct. 2004, which claims benefit of European patent application No. 03103883.9 filed 21 Oct. 2003 and of International application No. PCT/EP04/051407 filed 8 Jul. 2004.

FIELD OF THE INVENTION

The invention relates to a nozzle unit for generating an abrasive jet.

Such a nozzle unit can be used for excavating a hole into an object. The invention further relates to an apparatus comprising a nozzle unit. The invention also relates to a method of excavating a hole in an object.

BACKGROUND OF THE INVENTION

A nozzle unit in accordance with the above is generally known in the field of abrasive water jet machining. Devices for abrasive water jet machining typically operate at an ambient pressure substantially equal to atmospheric pressure. The water jet, which is virtually free of any solids, is jetted into a mixing chamber at a pressure of well above 1 kbar. A dry abrasive material is kept at atmospheric pressure and due to the jet pump mechanism in the mixing chamber, the abrasive particles are sucked into the mixing chamber through the abrasive particle inlet.

In the field of drilling holes into geological earth formations, an abrasive water jet system including a nozzle unit with a jet pump mechanism can be used for drilling a hole, see for example WO 02/34653. However, the conditions in this field are substantially different from the field of atmospheric abrasive jet machining since the ambient pressure is well above atmospheric pressure and increases with about 1 bar per 10 meters depth.

In the case of the atmospheric abrasive water jet machining systems, air is sucked into the mixing chamber together with the abrasive particles. This air flow into the nozzle unit may generate cavitation that can limit the transfer of kinetic energy from the water jet to the abrasive material. Consequently, the efficiency of the nozzle unit, which is based on this kinetic energy transfer, is limited by the cavitation.

Another important source of cavitation may stem from turbulence in and around the jet stream. Pressure fluctuations in the turbulence locally include pressures below the vapour pressure of the carrier fluid, which possibly causes vaporization, the creation of gas bubbles, and cavitation.

There is a desire for a nozzle unit that is able to impart at an as high as possible efficiency kinetic energy to abrasive particles at an as low as possible consumption rate of abrasive particles so that the nozzle unit can be used within a limited space available in a typical bore hole in a geological earth formation.

International application WO-A 91/12930 mentions an efficiency reduction of conventional nozzle units when applied in increased ambient pressure conditions, and reports the construction of a nozzle unit that allows for a relatively easy modification of the mixing chamber length. This measure corrects the nozzle design for the increase in jet divergence caused by the gradual decrease of a cavitation shield around the jet with ambient pressure.

U.S. Pat. No. 4,555,872 describes a nozzle apparatus in accordance with the preamble for generating an abrasive fluid jet stream having material cutting capabilities for objects at atmospheric pressure. A first nozzle is provided with an orifice plate of sapphire, having a cone-shaped orifice of which the smallest flow opening has a diameter of approximately 0.5 mm (0.020 inch). Herewith an extremely high pressure-drop is achievable at a low flow rate. A second nozzle downstream of the first nozzle is provided in the form of a tapered flow shaping cone, of which the smallest flow opening has a diameter of approximately 1.5 mm (0.060 inch).

It has been found that none of the prior art nozzle units described above is capable of delivering a satisfactory abrasive jet stream in a high pressure surrounding such as is typically encountered when drilling holes into geological earth formations, taking into consideration special boundary conditions that apply.

SUMMARY OF THE INVENTION

In accordance with the invention there is provided a nozzle unit for generating an abrasive jet, which nozzle unit comprises a first nozzle connected to a pressurized carrier fluid supply, a mixing chamber in which the first nozzle discharges a second nozzle connected to the mixing chamber, and an abrasive particle inlet discharging in the mixing chamber, wherein the proportion of the cross sectional area of the first nozzle opening and the cross sectional area of the second nozzle opening is greater than or equal to 0.50 and lower than 1.

There is also provided a combination of a nozzle unit as defined above and a separation device for separating magnetical or magnetizable abrasive particles from a fluid, which separation device comprises a magnet body for attracting the abrasive particles out of a fluid flowing along the separation device, and a support surface at least partially enveloping the magnet body, and means for transporting attracted abrasive particles along the support surface to the abrasive particle inlet of the nozzle unit.

The invention also provides a method of excavating a hole into an object, comprising the steps of:

- arranging an abrasive jet excavating tool comprising a nozzle unit according to the invention into the hole;
- generating an abrasive jet by supplying a pressurized carrier fluid to the first nozzle and discharging abrasive particles into the mixing chamber; and
- directing the abrasive jet into the object.

BRIEF DESCRIPTION OF THE DRAWINGS

These and other features of the invention will be elucidated below by way of example and with reference to the accompanying drawing.

Figure 1:
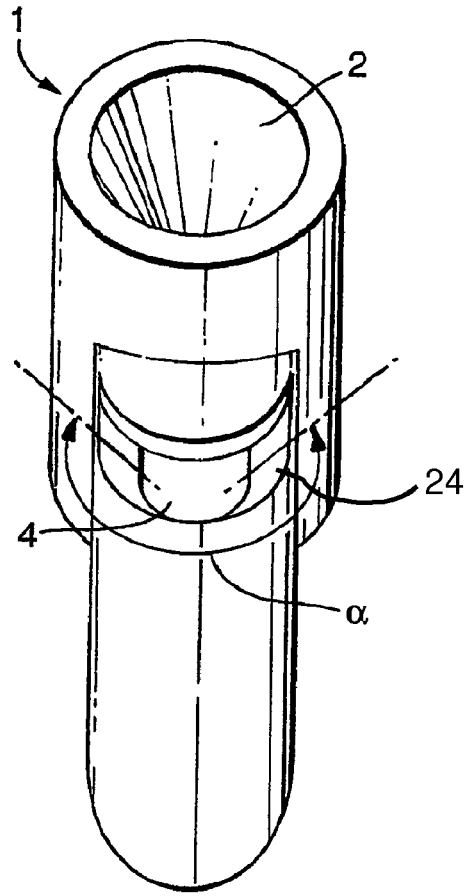
FIG. 1 schematically shows a perspective view of an embodiment of the nozzle unit according to the invention.

For the purpose of this specification, an object is understood to include primarily earth formations, including subterranean earth formations, and also cement, casing steel, or packer material in a well for the exploration or production of hydrocarbons. Such types of objects can in normal operation be located several kilometers depth under the earth surface, such that the ambient pressure can exceed 300 bars.

The present nozzle unit comprises:

a first nozzle connected to a pressurized carrier fluid supply;

a mixing chamber in which the first nozzle discharges;

a second nozzle connected to the mixing chamber; and an abrasive particle inlet to the mixing chamber.

It has been found that the larger the cross sectional area of the second nozzle flow opening is compared to that of the first nozzle, the more abrasive particles need to be entrained in the flow of the carrier fluid in order to achieve a substantial amount of kinetic energy transferred from the jet stream created by the first nozzle (the "driving jet") to the entrained abrasive particles. This transfer of kinetic energy is considered to be the efficiency of the nozzle unit.

If the proportion between the first and second nozzle cross sectional areas is less than 0.5, a relatively large amount of abrasive particles is required to fill the space in the second nozzle causing problems to supply the abrasive particles, in particular in a down-hole application where there is not much operational volume available. It would be possible to allow a higher ratio of entrained fluid verses abrasive particles to enter into the mixing chamber via the abrasive particle inlet. However, this leads to an undesired lowering of efficiency, because the entrained fluid consumes kinetic energy out of the driving jet but is non-effective for hole excavating compared to a similar amount of kinetic energy vested in the abrasive particles. Thus, the lower limit of allowable proportion between first and second nozzle cross sectional areas is 0.5.

On the other hand, the cross sectional area of the second nozzle should always be larger than the area of the first nozzle, i.e. a proportion of less than 1, in order to accommodate at least some entrained abrasives in addition to the high pressure jet stream.

Unlike the design of the nozzle unit described in WO-A 91/12930, the nozzle unit according to the invention is optimized to accommodate the supply and relative flow rates of the carrier fluid, the abrasive particles, and entrained fluid.

It is believed that for this reason the nozzle unit according to the invention has been satisfactory operable under high ambient pressure, in particular at an ambient pressure of higher than 50 bars, or of even higher than 300 bars. The nozzle unit is therefore particularly suitable for application in excavating subterranean earth formations at depths exceeding a few hundred meters up to several kilometers.

It is remarked that the said proportion of first and second nozzle cross sectional areas in the nozzle apparatus of U.S. Pat. No. 4,555,872 is only 0.11.

Preferably the said proportion of cross sectional areas is lower than 0.9, so as to ensure that a sufficient number of abrasive particles can be entrained in the flow of carrier fluid.

In a preferred embodiment of the invention the length in the flow direction of the mixing chamber is such, that taking into account the divergence of the jet from the first nozzle, the diameter of the jet leaving the mixing chamber is smaller than the diameter of the second nozzle opening.

It has been found that this preference can be more easily met when the proportion of cross sectional areas is lower than 0.60. A submerged jet typically has a divergence of 8°-9° (see "The theory of turbulent jets" by G. N. Abramovich, MIT press, Massachussetts (1963)). The length is defined as the distance between the exit opening of the first nozzle and the entry opening of the second nozzle. The entry opening is defined as the first point, where the smallest cross-section is present.

In an embodiment of the invention the length of the mixing chamber is in the range of 0.8-2.0 times the diameter of the first nozzle opening. This provides for an efficient mixing of the abrasive particles with the jet, while keeping the length of the mixing chamber limited. This has the advantage, that the jet can be placed under an angle, which is necessary when drilling holes. When using the nozzle unit according the invention, the nozzle is rotated, such that a hole with a substantial circular cross section is generated.

In view of this use, it is furthermore preferred that the length of the second nozzle is in a range of 4-10 times the second nozzle diameter.

In an embodiment of the invention, the second nozzle is eccentrically arranged relative to the first nozzle with respect to the flow direction. Preferably the eccentric displacement of the second nozzle has a component in the direction of the abrasive particle inlet. Herewith it is constructionally easier to keep the smallest dimensions of the abrasives supply opening substantially equal to the diameter of the first nozzle, while maximizing the proportion of the cross sectional area of the first nozzle to the second nozzle.

The eccentric displacement is preferably up to the situation that part of the first nozzle wall is in line with part of the second nozzle wall. In the case of both a cylindrical first nozzle and a cylindrical second nozzle the eccentricity E is then equal to half the difference between the two nozzle diameters.

It is furthermore preferred that at least part of an inside wall of the first nozzle is aligned with at least part of an inside wall of the second nozzle.

In an embodiment of the invention, the nozzle unit comprises a supply channel connected to the abrasive supply inlet, wherein the supply channel surrounds the mixing chamber by an angle of less than 180°. In this way efficient use can be made of the eccentric secondary nozzle configuration when provided. At the same time, the supply inlet should be sufficiently wide to be able to supply abrasive particles without substantial risk of blockage.

The included angle β between the flow direction in supply channel 24 and an axis along the flow direction in the primary nozzle is preferably as small as possible. This way the supplied abrasive particles get an as large as possible velocity component parallel to the jet stream generated by the primary nozzle. In an embodiment of the invention, the angle β smaller than 60°, preferably smaller than 30°. Due to mechanical constraints, the angle β typically larger than 10°.

In FIG. 1 a perspective view of a nozzle unit 1 according to the invention is shown. The nozzle unit 1 is advantageously manufactured out of tungsten carbide based materials, for instance similar materials as used for mixing tubes in the field of abrasive water jet machining.

The nozzle unit 1 has an inlet 2, for supply of a pressurized carrier fluid to the nozzle unit 1. In addition, the nozzle unit has an abrasive particle inlet 4. Abrasive particles can reach the abrasive particle inlet via a supply channel 24 that is connected to the abrasive supply inlet 4. As can be seen in FIG. 1, supply channel 24 surrounds the abrasive supply inlet 4 by an angle α. The angle α is preferably more than 90° and less than 180°, and in the preferred embodiment as shown in FIG. 1 it is 140°.

Figure 2:
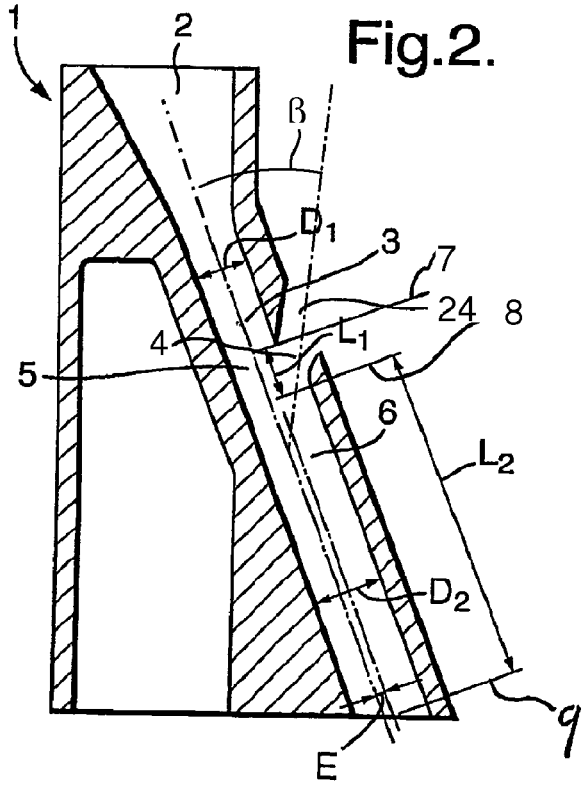
FIG. 2 schematically shows a cross sectional view of the nozzle unit according to FIG. 1 along line X-X.

Referring now to FIG. 2, the inlet 2 leads to a first nozzle 3. In the embodiment, the first nozzle 3 has a circular cross section, having a smallest waist diameter $D_1$ corresponding to a flow opening having a first cross sectional flow area of $A_1$ in the narrowest flow restriction. The nozzle 3 may have a non-circular cross section instead, such as an oval cross section.

The first nozzle 3 discharges into a mixing chamber 5, which mixing chamber has a length along its flow direction of $L_1$ measured between the exit plane 7 of the first nozzle 3 and the exit plane 8 of the mixing chamber 5 similar to the definitions given on page 260 of "Applied fluid dynamics handbook" by R. D. Blevins, 1992 edition Krieger Publishing Company, Florida. The abrasive particle inlet 4 also discharges into the mixing chamber 5.

The exit plane 7 of the first nozzle 3 is defined as the plane perpendicular to the flow direction located just at the point where as seen in flow direction through the nozzle the flow opening widens. Likewise, the exit plane 8 of the mixing chamber is defined as the plane perpendicular to the flow direction located just at the point where as seen in flow direction through the mixing chamber the flow opening is at its maximum restriction, and thus coincides with the entrance plane of the second nozzle 6. In a similar way as for the first nozzle, there is also defined an exit plane 9 of the second nozzle 6.

A second nozzle 6 is connected to the mixing chamber 5 on a downstream side thereof, a smallest waist diameter $D_2$ corresponding to a flow opening having a first cross sectional flow area of $A_2$ in the narrowest flow restriction, and a nozzle length $L_2$ measured between entrance plane 8 and exit plane 9 Like the first nozzle, the second nozzle 6 may have a non-circular cross section, such as an oval cross section, but in the preferred embodiment of FIG. 2 the nozzle 6 is circular having a diameter $D_2$.

The second nozzle 6 is eccentrically placed relative to the first nozzle 3. The amount of eccentricity is indicated in the drawing by E. The eccentricity E in this case equals half of the difference between the two nozzle diameters ($D_2-D_1$) so that the first and second nozzle inside walls on the side opposite of the abrasive particle inlet 4 are aligned with each other.

In operation, a pressurized carrier fluid is supplied to the nozzle unit 1 through inlet 2 from where it is jetted through the first nozzle 3 into the mixing chamber 5 to from a driving jet steam. Abrasive particles, together with an entrainment fluid, are entrained by the driving jet which includes entering through the abrasive particle inlet 4 into the mixing chamber 5. In the mixing chamber 5 a mix of the driving jet, the entrainment fluid and the abrasive particles is formed. The mix is then transported through the second nozzle 6, from where it leaves the nozzle unit 1 in the form of an abrasive jet. The abrasive jet can be directed against an object to be excavated.

When the ratio $A_1/A_2$ is properly chosen, the velocity of the carrier fluid through the mixing chamber creates an effective suction drawing the abrasive particles into the mixing chamber. The abrasive particles are best fed into the mixing chamber via the abrasive particle inlet 4 together with an entrained fluid or an entrained liquid.

Figure 3:
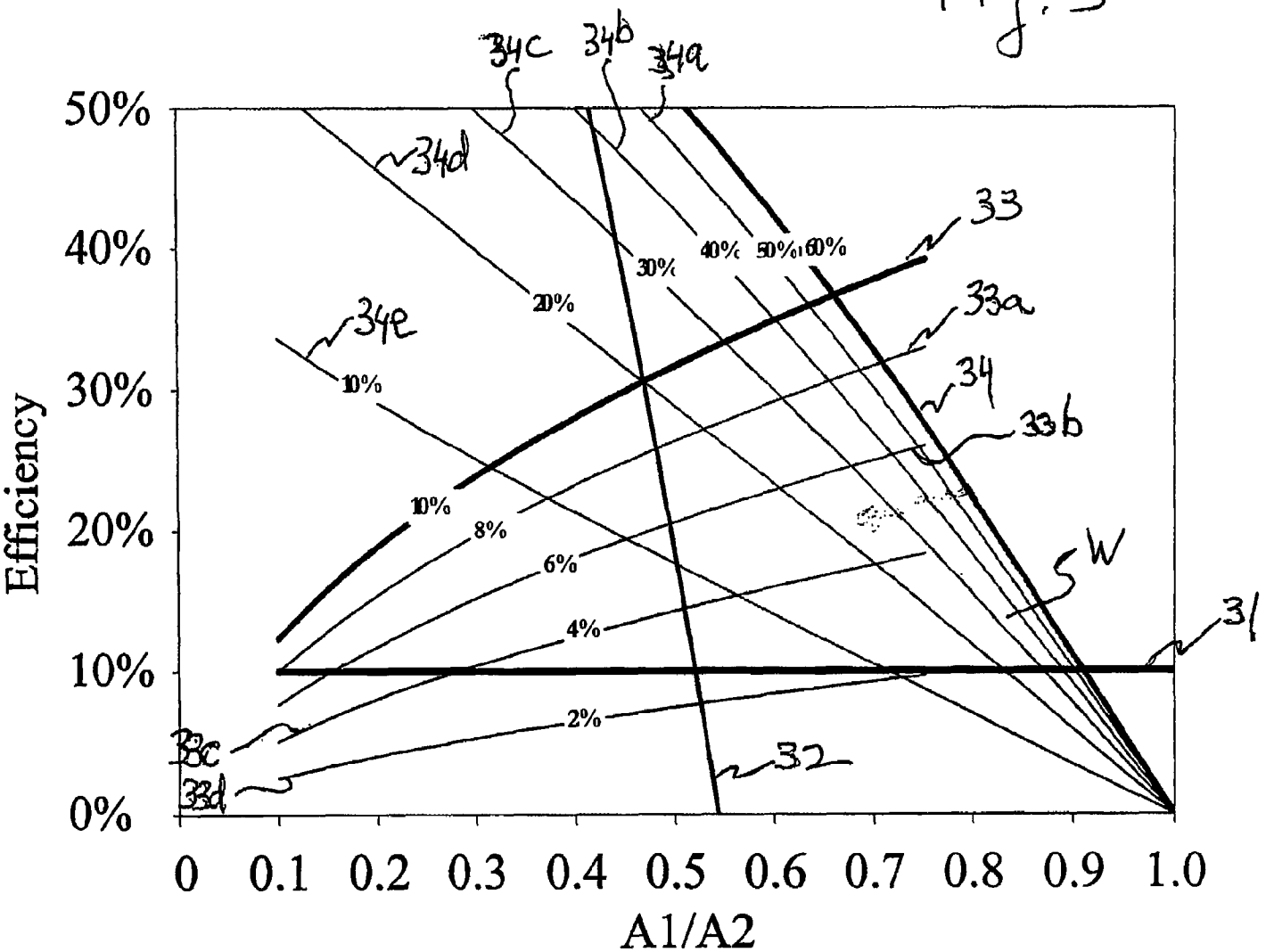
FIG. 3 shows a calculated graph setting out nozzle unit efficiency against ratio of nozzle cross sections.

FIG. 3 shows a graphic representation of a calculation of nozzle unit efficiency based on laws of conservation of energy, using volumetric flow rates for respectively the carrier fluid through the first nozzle ($Q_{in}$), the entrained total volumetric flow rate of fluid and abrasive particles flowing into the mixing chamber via the abrasive particle inlet ($Q_{ent}$), and the flow rate exiting the nozzle unit, $Q_{out}$, which is the sum of $Q_{in}$ and $Q_{ent}$. The volumetric flow rate of abrasive particles, $Q_{abr}$, is part of $Q_{ent}$. The entrained mass density is a function of the density of the carrier fluid (typically 1.2 kg/l), the density of the abrasive particles (typically 7.4 kg/l for steel shot), and the volumetric concentration of abrasives in the entrainment flow.

On the horizontal axis is plotted the ratio $A_1/A_2$ representing ratio of the cross sectional area of the first nozzle opening and the cross sectional area of the second nozzle opening and on the vertical axis the efficiency of the nozzle unit in terms of percentage of kinetic energy transfer from the jet created by the primary nozzle to the abrasive particles.

A preferred area W is hatched into the graph. The area is bound by lines 31, 32, 33, and 34, each of which have been found to result from a certain limits or constraints associated with generating an abrasive jet stream in down-hole conditions for drilling holes into a geological earth formation.

Of these lines, line 31 represents an efficiency of 10%, which sets a preferred lower limit necessary to obtain a minimum excavating rate that is desired to maintain an economically viable operation.

Line 32 represents the efficiency versus area ratio behaviour under the condition that $Q_{ent}$ is half of $Q_{in}$. The drilling-fluid circulation through the well restricts $Q_{in}$ to a limited range of values. A relative increase of $Q_{ent}$ compared to $Q_{in}$ corresponds to a lower area ratio for any efficiency value, but it is considered impractical for a down hole tool to supply a high flow rate through the abrasive particle inlet in the spatially restricted down hole environment. The total flow rate between the mixing chamber and the hole bottom, $Q_{out}$, is the sum of $Q_{ent}$ and $Q_{in}$, and an increasing $Q_{ent}$ leads to correspondingly increasing fluid and particle velocities in the annular stream. It is preferred to maintain $Q_{out}$ not higher than 150% Of $Q_{in}$, thus $Q_{ent}$ should not exceed 50% of $Q_{in}$.

In addition to that, an increase of $Q_{ent}$ also requires an increase of $Q_{abr}$ in order to at least maintain the efficiency of the nozzle unit. Otherwise, energy from the jet created by the first nozzle is transferred to drilling fluid instead of abrasive particles. The more solids the drilling assembly has to supply to the nozzle unit the more complex the system becomes. It is preferred to achieve a high efficiency with an as small as possible supply of entrained abrasives, $Q_{abr}$.

For the same reason it has been found that $Q_{abr}$ is best kept at 10% of $Q_{in}$ at the most. Line 33 represents the efficiency versus area ratio behaviour under the condition that $Q_{abr}$ is kept at a constant ratio of 10% of $Q_{in}$. Lines 33*a* to 33*d* show the efficiency versus $A_1/A_2$ for $Q_{abr}$=8, 6, 4, and 2% of $Q_{in}$, respectively.

Line 34 shows the efficiency versus area ratio behaviour under the condition that 60% of the total entrained volume (liquid and abrasive particles) $Q_{ent}$ is consumed by the abrasive particles. The packing of particles includes voids, and, therefore, the concentration of abrasive particles in the entrained fluid is less than 100%. A typical value for the maximum concentration is 60%, which is the ratio between the typical steel shot bulk density (4.4 kg/l) and grain density (7.4 kg/l). Lines 34*a* to 34*e* correspond to the conditions that $Q_{abr}$=50, 40, 30, 20, and 10% of $Q_{ent}$, respectively. It can be seen that the lower the percentage the lower the efficiency. This is due to the fact that a higher fraction of the energy vested in $Q_{in}$ will be transferred to the fluid component of the entrained volume instead of the abrasive particles.

Generally, the ratio $A_1/A_2$ of the cross sectional area of the first nozzle opening and the cross sectional area of the second nozzle opening should be in a range of 0.50 to 1.0, preferably in a range of 0.50 to 0.90 to allow for higher efficiencies. Efficiencies of 20% or more are achievable by selecting $A_1/A_2$, to be in a range of 0.50 to 0.80. Most preferably, the area ratio $A_1/A_2$ is selected in a range of 0.50 to 0.60, to also maximally facilitate the second nozzle to receive a diverged jet stream.

The length of the mixing chamber best lies in a range of 0.80 to 2.0 times $D_1$. The length $L_2$ of the second nozzle best lies in a range of 4 to 10 times $D_2$.

In the preferred embodiment as shown in FIG. 2, the ratio $A_1/A_2$ is 0.56 (corresponding to $D_1/D_2$=0.75). The length $L_1$ of the mixing chamber is 1.1 times $D_1$; the length $L_2$ of the second nozzle 6 is 7 times $D_2$.

The nozzle works best with a carrier fluid in liquid form, particularly water or a drilling mud. The pressure differential over the fist nozzle 3 is typically between 100 and 700 bars. The high pressure jet diverges by approximately 8 to 9° as it leaves the first nozzle 3. With the relative dimensions of the nozzle unit 1 as given above, the high-pressure jet discharged from the first nozzle 3 into the mixing chamber 5, should completely enter into the second nozzle 6. In particular, by having the abrasive particle inlet 4 on one side of the mixing chamber 5 and the inside walls of the first and second nozzles on the opposing side in alignment with each other, it is achieved that the flow from the first nozzle 3 into the second nozzle 6 is optimized.

Figure 4:
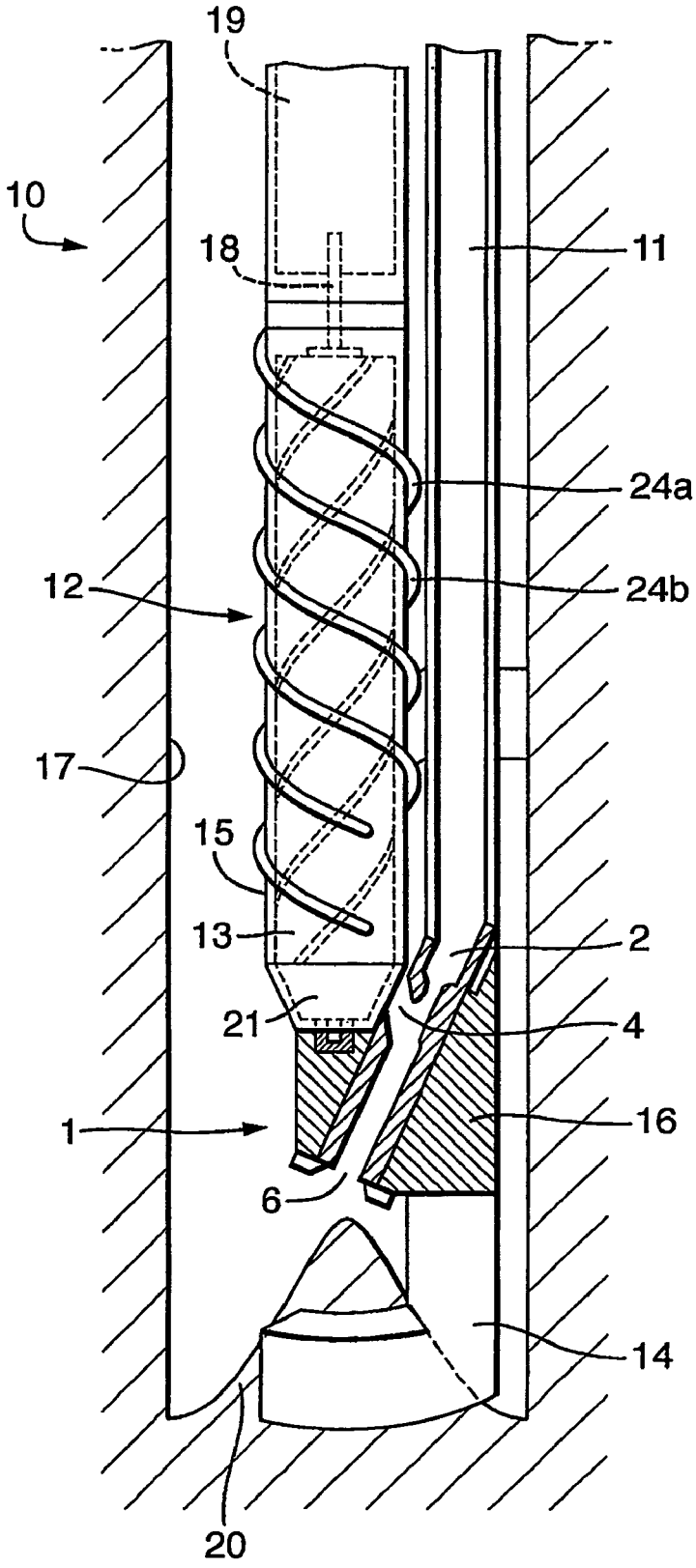
FIG. 4 schematically shows a schematic cross sectional view of an excavating tool comprising the nozzle unit according to an embodiment of the invention.

FIG. 4 shows a schematic cross section of an excavation tool comprising a combination 10 of a nozzle unit 1, which may be the nozzle unit as shown in FIGS. 1 and 2, and a separation device 12 for magnetically separating abrasive particles from a fluid. Other than the nozzle unit, the separation device 12 and the excavation tool are similar to those disclosed in International publication WO 02/34653, the content of which is herewith incorporated by reference.

For this tool the abrasive particles should comprise or be made of a magnetizable material, such as steel shot. The excavating tool 6 is provided with a longitudinal drilling fluid passage 11 in fluid communication with the nozzle unit 1 via inlet 2, for supplying the pressurized carrier fluid.

The separation device 12 comprises a magnetic body 13, rotatably arranged in a support sleeve 15. The magnetic body 13 generates a magnetic field for retaining the abrasive particles on the support sleeve 15. The inlet 4 for abrasive particles is located at the lower end of the support sleeve 15.

The magnetic body 13 has a central longitudinal shall 18 and is rotatable relative to the sleeve 15 about the central longitudinal shaft 18. Drive means 19 are provided to drive shall 18. The magnetic body 13 contains helical bands of increased magnetic field strength and helical bands of relatively low magnetic field strength. Preferably, the magnetic body 13 is formed by a stack of individual smaller magnets such as described in International publication WO2005/005766 of which application priority is presently claimed and which is hereby incorporated by reference.

The second nozzle 6 is arranged above an optional foot part 14, and is inclined relative to the longitudinal direction of the excavation tool 10 at an inclination angle of 15-30° relative that direction, but other angles can be used. Preferably the inclination angle is about 21°, which is optimal for abrasively eroding the bottom of the bore hole 17 by axially rotating the complete excavation tool 10 about its longitudinal direction inside the bore hole 17.

Further details on various parts of the abrasive particle recirculation system and excavating tool can be found in International publication WO2005/005766, already mentioned above.

In operation, the excavating tool 10 works as follows. The excavation tool 10 is connected to the lower end of the drill string (not shown) that is inserted into the borehole 17. The pressurized carrier fluid is supplied in the form of a drilling fluid that is pumped by a suitable pump (not shown), the drill string and the fluid passage 11 into the nozzle unit 1. During pumping, the drilling fluid is provided with a small amount of abrasive particles.

As explained above, the first nozzle 3 is arranged with a flow restriction, over which a pressure drop is present which drives the acceleration of the drilling fluid.

The drilling fluid flows through the mixing chamber 5 into the second nozzle 6, and is jetted against the borehole bottom 20. Simultaneously the excavation tool is rotated about its longitudinal axis. A return stream of drilling fluid and abrasive particles flows from the borehole bottom 20 through the annulus between the borehole 17 and the excavation tool, thereby passing along the support sleeve 15.

Simultaneously with pumping of the stream of drilling fluid, the magnet 13 is rotated about its shaft 18. The magnet 13 induces a magnetic field extending to and beyond the outer surface of the support sleeve 15. As the return stream passes along the support sleeve 15, the abrasive particles in the stream are separated out from the stream by the magnetic forces from the magnet 13 which attract the abrasive particles onto the outer surface of the support sleeve 15.

The stream of drilling fluid, which is now substantially free from abrasive magnetic particles, flows further through the bore hole to the pump at surface and is re-circulated through the drill string after removal of the drill cuttings.

The magnetic abrasive particles retained on the support surface 15 are attracted towards the helical band having the highest magnetic field. Due to rotation of the magnet 13, and the helical bands of high and low magnetic field strengths, the abrasive particles are forced to follow a helically downward movement along the support sleeve 15.

As the particles arrive at the abrasive particle inlet 4, the stream of drilling fluid flowing from the first nozzle 3 into the mixing chamber 5 again entrains the abrasive particles. Thus, the abrasive particles are again jetted against the borehole bottom 20 and subsequently flow in upward direction through the borehole 17. The cycle is then repeated continuously.

In order to enhance the downward transport of the abrasive particles along the support sleeve 15, the support sleeve 15 may by slightly tapered to that its diameter at its lower end is smaller than at its upper end. A short tapered section 21 may be provided at the lower end of magnet 13 whereby the support sleeve 15 is provided with a corresponding conical taper in a manner that the inlet 4 for abrasive particles provides fluid communication between the support surface 15 surrounding the tapered section 21 and the mixing chamber 5.

The conical taper is best based on the same angle as the above-discussed inclination angle of the second nozzle 6.

The support sleeve 15 as shown in FIG. 4 is provided with a helically extending guide plates 24*a* and 24*b* protruding outwardly from the surface of the support sleeve 15. This guides the abrasive particles on their way down along the support sleeve 15. The downward transport velocity of the abrasive particles is increased if the guide plates run vertically parallel to the longitudinal axis. Preferably, the drilling fluid passage 11 can be provided in longitudinal contact with the support sleeve 15 as the guide plate, replacing the separate guide plates 24*a* and 24*b*.

Referring again to FIG. 4, a magnetic attractor body 16 is preferably provided adjacent the mixing chamber on the side of the mixing chamber opposite to the abrasive particle inlet 4. This causes magnetic field lines to run from the lower end 21 of the magnet to this magnetic body. As a result, the magnetic field from the cylindrical magnet is pulled inside the mixing chamber 5. This achieves that the magnetic abrasive particles can form chains from the lower end of the support surface 15 towards the magnetic attractor body 16, thereby crossing the jet that is discharged from the first nozzle 3. The particles in these chains thereby interact with the stream of drilling fluid passing through the mixing chamber 5, and thus the entrainment of these particles in the drilling fluid will be enhanced.

Suitable magnets can be made from any highly magnetisable material, including NdFeB, SmCo and AlNiCo-5, or a combination thereof. Preferably the magnet also has a magnetic energy content of at least 140 kJ/m$^3$ at room temperature, preferably more than 300 kJ/m$^3$ at room temperature such as is the case with NdFeB-based magnets.

The sleeve 15 and the drilling fluid passage 11 are best made of a non-magnetic material. Super alloys, including high-strength corrosion resistant non-magnetic Ni—Cr alloys, in particular a Ni—Cr alloy available under the name Inconel-718, have been found to be particularly suitable.

Typical dimensions relating to the excavating tool are given in the following table.

| Part name | Reference number | Size |
|---|---|---|
| Outer diameter of foot part | 14 | 73 mm |
| Axial length of magnet | 13 | 120 mm |
| Outer diameter of magnet | 13 | 29 mm |
| Diameter in lower part of support surface | 15 | 34 mm |
| Diameter in upper part of support surface | 15 | 52 mm |

The abrasive particles have a specific gravity (in the case of steel shot or steel grit particles: 7-8 SG), which is substantially higher than the typical specific gravity of the drilling fluid (0.8-2.3 SG). This improves the situation that a relatively small volumetric entrainment rate of abrasive material is sufficient for a substantial kinetic energy transfer.

I claim:

1. A nozzle unit for generating an abrasive jet, which nozzle unit comprises:

a first nozzle connected to a pressurized carrier fluid supply, which first nozzle in a section thereof with its highest restriction defines a first nozzle opening having a cross sectional area $A_1$;

a mixing chamber in which the first nozzle discharges;

a second nozzle connected to the mixing chamber, which second nozzle in a section thereof with its highest restriction defines a second nozzle opening having a cross sectional area $A_2$; and an abrasive particle inlet discharging in the mixing chamber;

wherein the ratio $A_1/A_2$ is greater than or equal to 0.50 and lower than 1, wherein the first nozzle has an inside wall aligned with an inside wall of the mixing chamber and also aligned with an inside wall of the second nozzle.

2. The nozzle unit according to claim 1, wherein the first nozzle has an exit opening and the second nozzle has an entry opening and wherein the distance between the exit opening of the first nozzle and the entry opening of the second nozzle is such that, taking into account the divergence of the jet to be discharged from the first nozzle, the diameter of the jet leaving the mixing chamber is smaller than the diameter of the second nozzle opening.

3. The nozzle unit according to claim 1, wherein the first nozzle has an exit opening and the second nozzle has an entry opening and wherein the distance between the exit opening of the first nozzle and the entry opening of the second nozzle is in the range of 0.8-2.0 times the diameter of the first nozzle opening.

4. The nozzle unit according to claim 1, wherein the second nozzle has an entry opening and an exit opening and wherein the distance between the entry opening of the second nozzle and the exit opening of the second nozzle is in the range of 4-10 times the second nozzle diameter.

5. The nozzle unit according to claim 1, wherein the second nozzle is eccentrically arranged relative to the first nozzle.

6. The nozzle unit according to claim 1, comprising a supply channel connected to the abrasive supply inlet, wherein the supply channel surrounds the mixing chamber by an angle of less than 180°.

7. The nozzle unit according to claim 1, comprising a supply channel connected to the abrasive supply inlet, wherein the included angle between the flow direction in the supply channel and an axis along the flow direction of the primary nozzle, is smaller than 60°.

8. An apparatus comprising:

a nozzle unit according to claim 1, and a separation device for separating magnetic or magnetizable abrasive particles from a fluid, which separation device comprises a magnet body for attracting the abrasive particles out of a fluid flowing along the separation device, and a support surface at least partially enveloping the magnet body, and means for transporting attracted abrasive particles along the support surface to the abrasive particle inlet of the nozzle unit.

9. A method of excavating a hole into an object, comprising the steps of:

arranging into the hole an abrasive jet excavating tool comprising a nozzle unit, which nozzle unit comprises;

a first nozzle connected to a pressurized carrier fluid supply, which first nozzle in a section thereof with its highest restriction defines a second nozzle opening having a cross sectional area $A_1$;

a mixing chamber in which the first nozzle discharges;

a second nozzle connected to the mixing chamber, which second nozzle in a section thereof with its highest restriction defines a second nozzle opening having a cross section area $A_2$; and an abrasive particle inlet discharging in the mixing chamber;

wherein the ratio $A_1/A_2$ is greater than or equal to 0.50 and lower than 1, wherein the first nozzle has an inside wall aligned with an inside wall of the mixing chamber, generating an abrasive jet by supplying a pressurized carrier fluid to the first nozzle and discharging abrasive particles into the mixing chamber; and directing the abrasive jet into the object.

* * * * *